US012791212B2

(12) United States Patent
Sinur et al.

(10) Patent No.: US 12,791,212 B2
(45) Date of Patent: Nov. 10, 2026

(54) INDOOR AIR QUALITY MANAGEMENT APPARATUS AND METHOD

(71) Applicant: OVERTURE JV LLC, Sun Prairie, WI (US)

(72) Inventors: Richard R. Sinur, Hartford, WI (US); Seddik Rougab, Hartford, WI (US); Moataz Khalil, Hartford, WI (US); Jason Asmus, Hartford, WI (US); Ryan Revers, Hartford, WI (US)

(73) Assignee: OVERTURE JV LLC, Sun Prairie, WI (US)

( * ) Notice: Subject to any disclaimer, the term of this patent is extended or adjusted under 35 U.S.C. 154(b) by 0 days.

(21) Appl. No.: 18/179,647

(22) PCT Filed: Jan. 26, 2023

(86) PCT No.: PCT/US2023/011580

§ 371 (c)(1),
(2) Date: Mar. 7, 2023

(87) PCT Pub. No.: WO2023/150048

PCT Pub. Date: Aug. 10, 2023

(65) Prior Publication Data

US 2024/0377086 A1 Nov. 14, 2024

Related U.S. Application Data

(60) Provisional application No. 63/305,738, filed on Feb. 2, 2022.

(51) Int. Cl.

| | |
|---|---|
| ***F24F 11/74*** | (2018.01) |
| ***F24F 11/32*** | (2018.01) |
| ***F24F 11/63*** | (2018.01) |

(52) U.S. Cl.
CPC ..... *F24F 11/32* (2018.01); *F24F 11/63* (2018.01)

(58) Field of Classification Search
CPC .. F24F 11/32; F24F 11/63; F24F 11/74; F24F 2110/50
See application file for complete search history.

(56) References Cited

U.S. PATENT DOCUMENTS

2015/0032264 A1* 1/2015 Emmons ..... F24F 11/0001 700/276
2016/0116181 A1* 4/2016 Aultman ..... F24F 11/70 700/276

(Continued)

FOREIGN PATENT DOCUMENTS

WO WO2020055872 A1 3/2020
WO WO2020112981 A1 6/2020
WO WO-2020146315 A1 * 7/2020 ..... F24F 11/65

OTHER PUBLICATIONS

Search Report and Written Opinion for PCT Application No. PCT/US23/11580, mailed Apr. 14, 2023 (22 pages).

*Primary Examiner* — Mohammad Ali
*Assistant Examiner* — Vincent W Chang

(57) ABSTRACT

A method of controlling ventilation of air within a local environment of a structure includes determining an indoor air quality level based on signals from one or more monitoring devices located in the local environment. In indoor air quality system includes one or more monitoring devices that determine the indoor air quality level and activate one or more appliances based on the readings from the one or more monitoring devices.

22 Claims, 9 Drawing Sheets

(56) References Cited

U.S. PATENT DOCUMENTS

| | | | | |
|---|---|---|---|---|
| 2016/0318368 | A1 | 11/2016 | Alger et al. | |
| 2018/0158315 | A1 | 6/2018 | Sloo et al. | |
| 2018/0299159 | A1 | 10/2018 | Ajax et al. | |
| 2019/0154285 | A1 | 5/2019 | Pham et al. | |
| 2019/0221089 | A1 | 7/2019 | Wedig et al. | |
| 2020/0393152 | A1 | 12/2020 | Ramirez et al. | |
| 2021/0055015 | A1* | 2/2021 | Liu | F24F 11/54 |
| 2021/0239339 | A1* | 8/2021 | Morgan | F24F 11/58 |
| 2022/0010996 | A1* | 1/2022 | Carrieri | F24F 8/108 |
| 2022/0404056 | A1* | 12/2022 | Bloemer | F24F 11/58 |

* cited by examiner

INDOOR AIR QUALITY MANAGEMENT APPARATUS AND METHOD

PRIORITY CLAIM

This application claims priority under 35 U.S.C. § 119 (e) to PCT Application Serial No. PCT/US23/11580, filed Jan. 26, 2023 and U.S. Provisional Application Ser. No. 63/305,738, filed Feb. 2, 2022, which is expressly incorporated by reference herein.

BACKGROUND

The present disclosure relates to air quality, and particularly to an air quality system. More particularly, the present disclosure relates to an air quality system that is configured to improve air quality within a building.

SUMMARY

Features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

Figure 5:
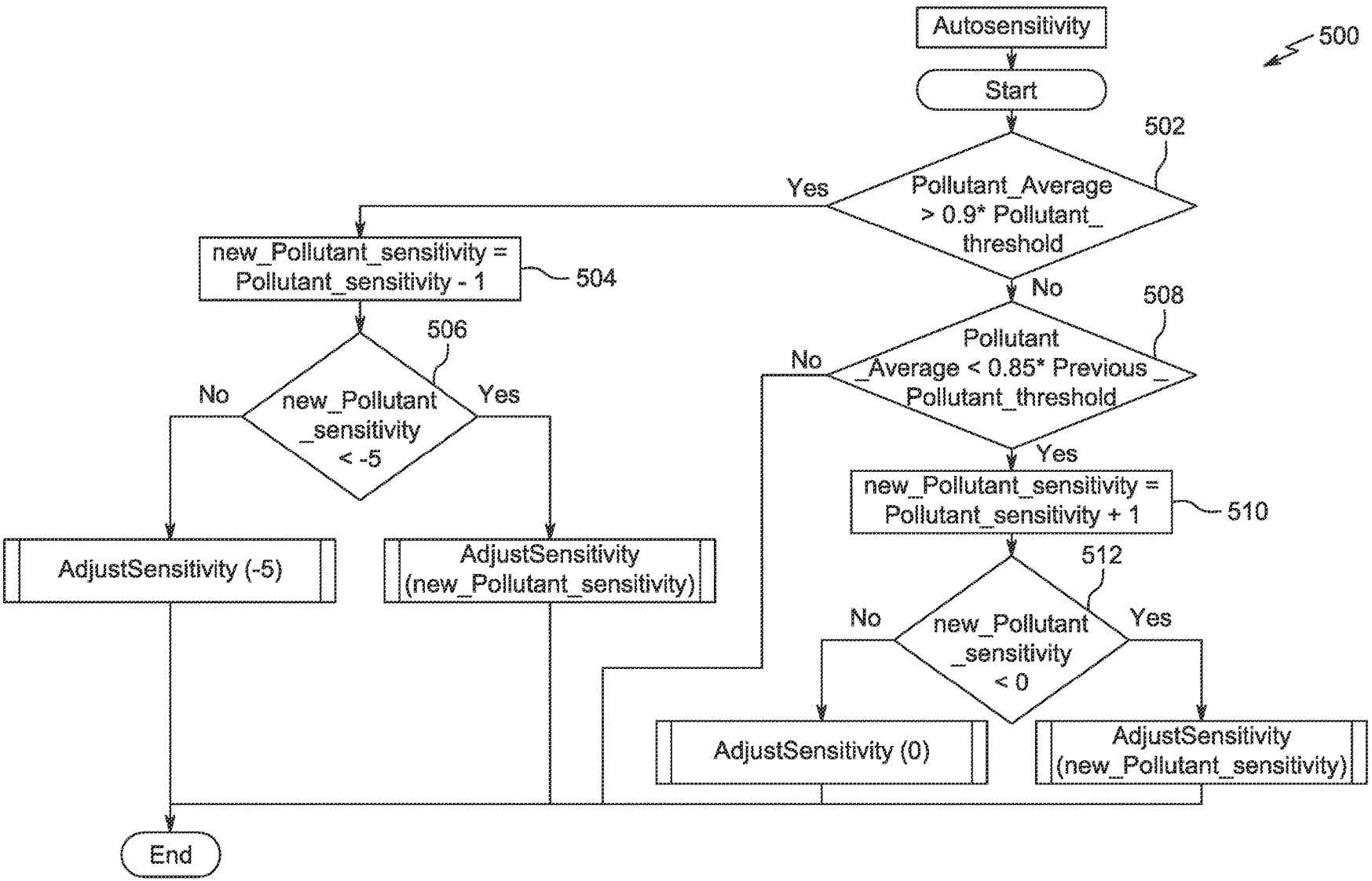
Figure 6:
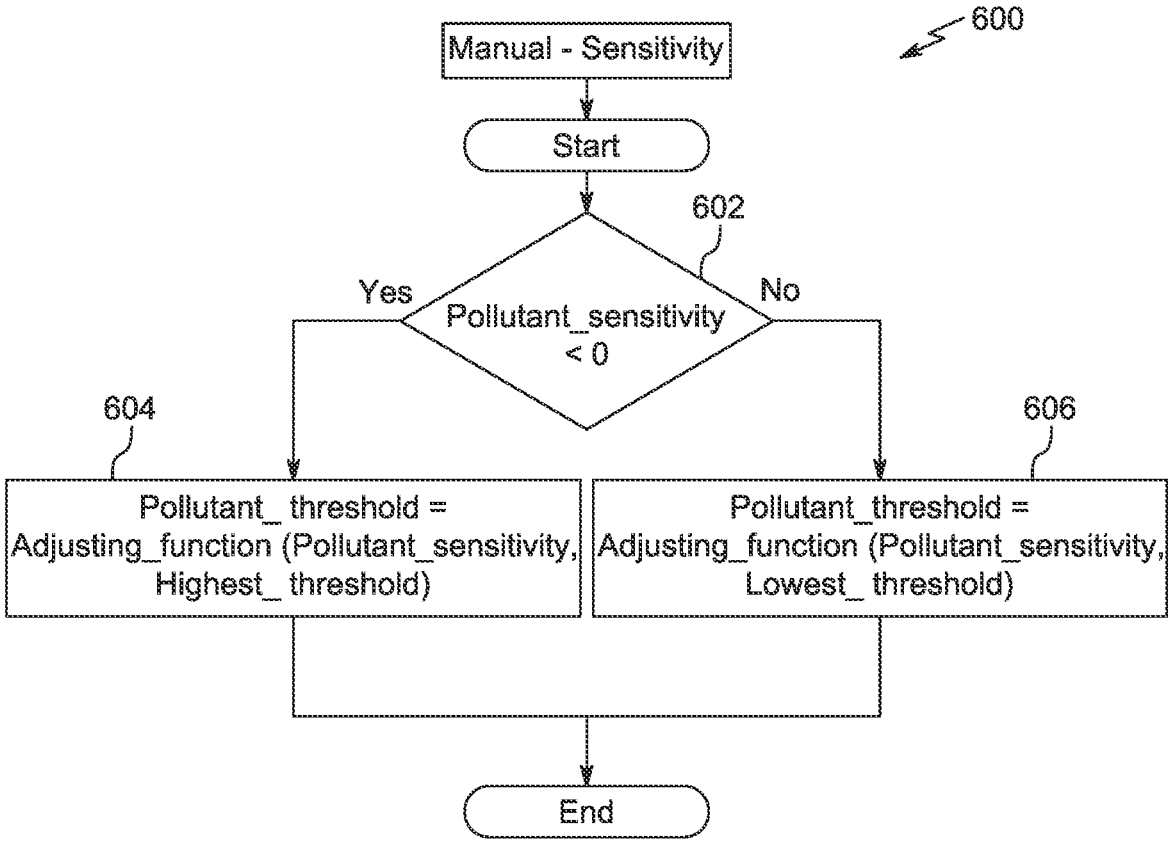

FIG. 5 is a schematic flow chart describing an auto-adjust function of the air quality system where threshold values for triggering the operation of one or more appliances included in the air quality system are automatically adjusted based on sensed values or conditions from the monitoring devices; and FIG. 6 is a schematic flow chart describing a manual-sensitivity adjustment function where the air quality system adjusts the threshold values for triggering the operation of one or more appliances based on inputs from a user that manually adjusts their sensitivity to a particular pollutant.

DETAILED DESCRIPTION

Figure 1:
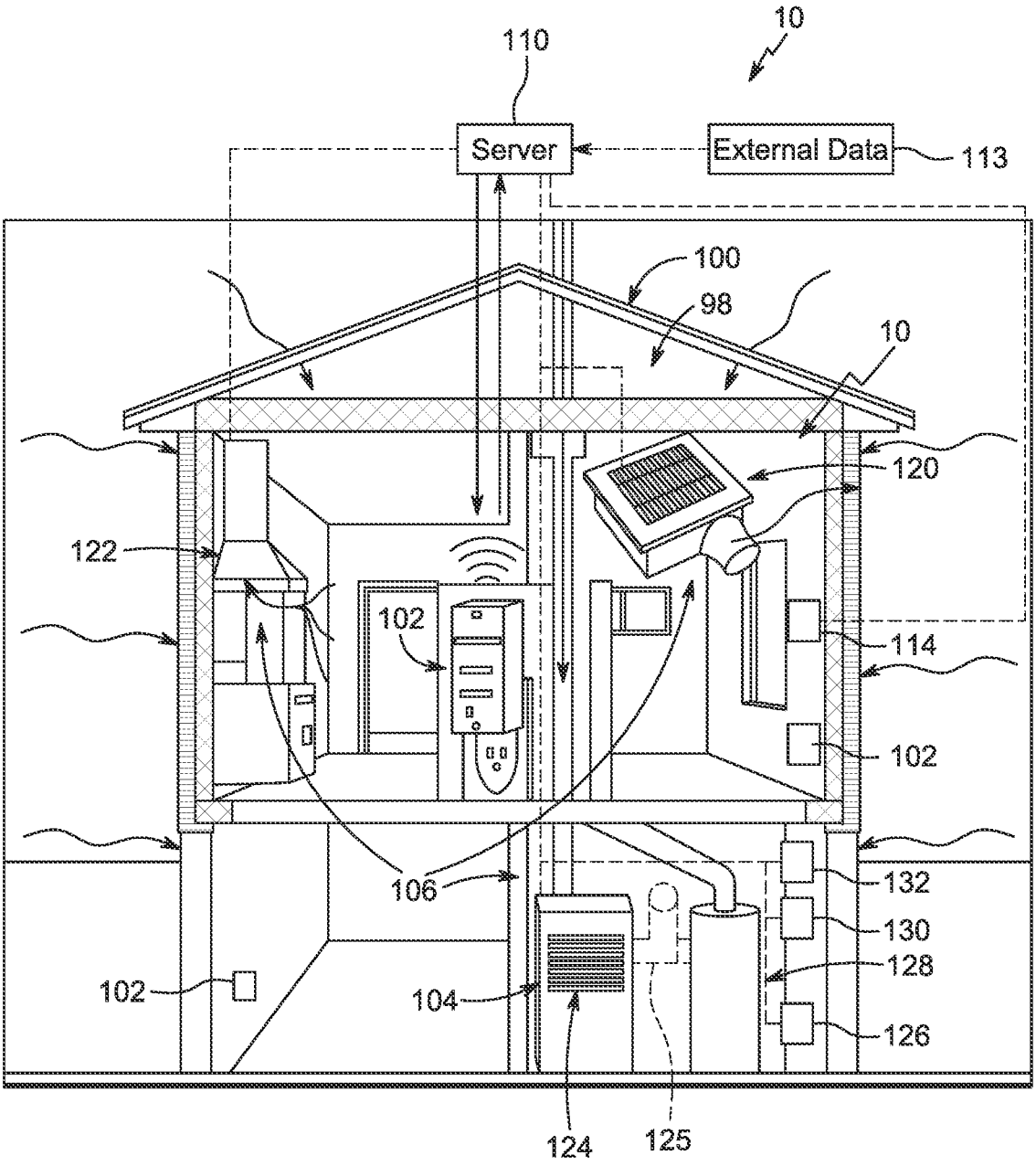
FIG. 1 is a side elevation view of a building with a side of the building removed to show an air quality system having a plurality of monitoring devices and a plurality of appliances that operate in response to signals from the monitoring devices and external data.

An indoor air quality (IAQ) system 10 that is capable of obtaining IAQ data—namely air quality information, such as pollutant levels—from a monitoring device 102 and/or a connected appliance 106, which are contained within an operating environment 98—namely a structure 100 (e.g., commercial building, a residential building, a single-family home, an apartment, hotels, etc.)—and an external data source 113 is shown in FIG. 1. The devices 102 and 106 are configured to record IAQ data from the structure 100, which includes various components (e.g., temperature, humidity and/or pollutant levels, such as TVOC, CO2, PM2.5), and send the recorded levels of the components of the IAQ data to a local server/database 110. At the same time, the IAQ system 10 obtains outdoor air quality index (AQI) data external to the structure (e.g. weather, smoke, fog, temperature, humidity, dew point, and/or pollutant levels, such as TVOC, CO2, PM2.5) from various locations surrounding the structure 100 to compare with the IAQ data obtained within the structure 100. In some embodiments, the AQI data is calculated by and obtained from a government entity (i.e. the United States or Canada).

The local server/database 110 may be located in or around the structure 100 or may be located in a remote location to the structure 100. The local server/database 110 may: i) analyze the IAQ data, ii) determine if all levels contained within IAQ data are within predefined threshold ranges, and iii) may recommend that the IAQ system 10 take certain steps (e.g., turn ON/OFF various appliances) to bring certain levels of the components within the predetermined threshold range or adjust the levels of the components based on the AQI data from the AQI data source 113. The IAQ system 10 can carry out these steps by controlling the operational mode (e.g., ON/OFF and/or the speed of the fan) of one or more appliances 106 contained within the operating environment. Once the IAQ system 10 has determined that the levels contained within the IAQ data are within predetermined threshold ranges that counteract the anticipated AQI data, the IAQ system 10 may instruct the appliances 106 to turn OFF or take further action in response to the AQI data. It should be understood in certain embodiments that some of the devices set forth above may be omitted. Additionally, in other embodiments, the IAQ system 10 may include additional devices and/or components. Reference is hereby made to U.S. patent application Ser. No. 17/298,362, filed May 28, 2021, and U.S. patent application Ser. No. 17/417,471, filed Jun. 23, 2021, each of which is incorporated by reference here in in their entirety.

The monitoring device 102 includes at least one sensor, which it uses to collect data about the local environment 98 of the structure 100. Some or all of this IAQ data is then sent to the local server/database 110, which processes and stores this data. If the local server/database 110 determines that one level contained within the IAQ data is out of the predetermined threshold range, then the IAQ system 10 may be configured to operate one or more of the appliances 106 to adjust the level. If the local server/database 110 determines that levels contained in the AQI data are outside of the predetermined threshold ranges, the IAQ system 10 may further operate one or more of the appliances 106 to bring indoor air levels within certain ranges in response to the AQI data. For example, if the AQI data indicates that outdoor levels will be in an unacceptable range at 1 PM, the IAQ system 10 may ventilate the local environment 98 of the structure 100 prior to 1 PM. In some embodiments, the IAQ system 10 may exceed a ventilation threshold to over-ventilate the structure 100 prior to 1 PM to minimize indoor air contaminants levels and to anticipate the ventilation system shutdown at 1 PM and the associated indoor air contaminants rise.

In one embodiment, the monitoring device 102 is or includes a plurality of sensors for monitoring the environment 98 as depicted in FIG. 1. In some embodiments, each sensor is the same and is configured to measure a plurality of different levels of pollutants and other characteristics of the air in the local environment 98 of the structure 100. In some embodiments, one such sensor is located in each room of the structure 100 to provide data on air quality levels within each respective room. The data from each sensor are output to and collected by the local server/database 110. The levels can be averaged among each room to determine an overall level for each pollutant and/or characteristic of the air in the structure 100 as a whole. User preferences or inputs may be made to the IAQ system 10 to manually weight certain contaminant levels to cause the IAQ system 10 to address that contaminant(s) ahead of others. Certain contaminants may be weighted automatically based on health hazards. In some embodiments, dimensions of each room are stored in local server/database 110 and a weight is given to the air quality levels determined in each room based on the total volume of air in each respective room of the structure 100. In other embodiments, each sensor is different from one another and dedicated to measuring at least one specific pollutant. The monitoring device 102 can include one or more separate infrared (IR) sensors, one or more separate air pollutant sensors, one or more motion sensors, and one or more separate humidity/temperature sensors, with each sensor being positioned in different parts or rooms of the structure 100.

The AQI data source 113 may include distributed external sensors, weather pattern data, historical air quality databases, air quality prediction databases, and other information about the air that is exterior to the structure 100. For example, one external sensor may be located in the outside air supply duct to measure contaminant levels being brought into the local environment 98. The data source 113 may include a prediction table that is based on information derived from current and historical data collected from: i) exterior local/regional/national sensors (e.g. dew point, temperature, air pollutants), ii) sensors installed in other structures, iii) weather information, iv) electricity costs, and v) other similar types of data. The data contained within the data source 113 can be accessed by a combination of the national database 112 and the local server/database 110. This data can be utilized to help make predictions when levels of the components of both indoor air and outdoor air will be deemed to be out of predetermined threshold ranges and facilitate a determination of which corrective measures to take (e.g. operate one or more exhaust fans to exhaust indoor air and/or operate one or more supply fans to bring in outdoor air (also known as fresh air)). The data source 113 can be utilized to maximize the quality of the air contained within the structure 100 based on predictions about the exterior environmental conditions. In some situations, alerts from a National/Regional weather surveillance service may be input and stored in the local server/database 110 and utilized when operating the IAQ system 10.

A user may be required to enter their zip code into the IAQ system 10. The IAQ system 10 may use this zip code to determine the closest AQI weather station and allow the user to change the default. The zip code may also be used to select the default (AQI vs. Humidity). The IAQ system 10 may consider climate zones and determine by climate zone what will be the default condition. For instance, in the southern areas of the United States the default preference may be humidity while in western United States areas the default preference may be AQI. The user may have the ability to change the default and their preference if so desired.

If cost are associated with obtaining AQI data from data source 113, the IAQ system 10 may query all existing systems in the same or similar zip code. In this case, only one IAQ system 10 within that zip code may obtain the AQI data and the other IAQ systems 10 may obtain the AQI data from the first IAQ system 10, thus minimizing the number of calls and associated costs.

The one or more appliances 106 used with the IAQ system 10 can include any heating, ventilation, and air conditioning device or any device that controls/changes the air within local environment 98 (i.e. air purifiers, heaters, swamp coolers, humidifiers, etc.). In the illustrative embodiment, the appliances 106 used with the IAQ system 10 include one or more exhaust fans (i.e. bathroom fan(s) 120 or range hood(s) 122), a coupled or decoupled supply fan 124 (which can, optionally, be connected to or part of a central unit 104), an energy/heat recovery device 126, a dehumidification device 128, an air purifier 130, and/or a humidification device 132 as shown in FIG. 1. The one or more exhaust fans 120 are configured to remove air from the local environment to outside the structure 100 for ventilation purposes. The supply fan 124 is part of a fresh air system with at least one port 125 open to the ambient environment outside the structure 100, allowing the supply 124 to draw outdoor air into the indoor operating environment 98 of the building structure 100. The supply fan 124 is configured to circulate fresh air throughout the structure 100 via a plurality of ducts and vents/dampers. The port may include a damper (not depicted) to selectively open when fresh air is desired to be drawn into the local environment as explained in greater detail below. In an alternative embodiment, the supply fan 124 is not connected to a central unit 104, but instead simply draws outdoor air into the particular location of the building structure 100 in which the fresh air system is located. The supply fan 124 may also include an outlet port for exhaust purposes. The energy/heat recovery device 126 is coupled to one or more air inlet/outlet flows and is configured to exchange heat and/or energy between an intake airflow flowing into the structure 100 and an exhaust airflow flowing out of the structure 100 to minimize energy/heat loses as a result of operating the IAQ system 10. The dehumidification device 128 is configured to decrease relative humidity within the local environment 98. The humidification device 132 is configured to increase the relative humidity within the local environment 98. The air purification device 130 is configured to decrease the particles matter content of the air and/or the gaseous pollutants content of the air within the local environment 98. Each of the devices is activated or deactivated in response to the sensed indoor air condition levels from the monitoring devices 102 and the outdoor AQI data from the AQI data source 113, as explained in each of the scenarios described below, in order to optimize the IAQ.

Figure 2:
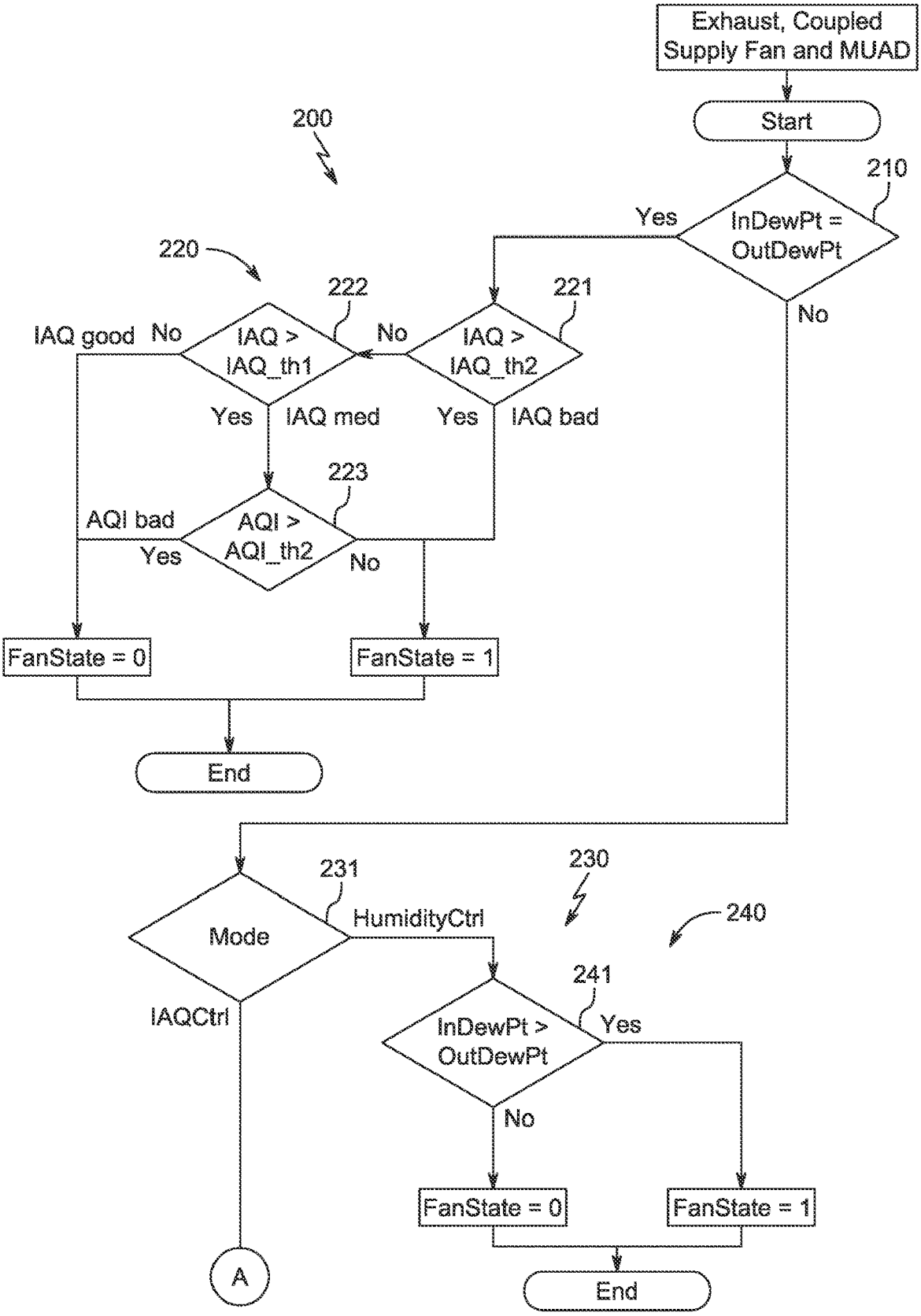
FIG. 2 is a first schematic flow chart describing the operation of the air quality system where the air quality system includes one or more exhaust fans and a coupled supply fan with a make-up air damper.
Figure 2:
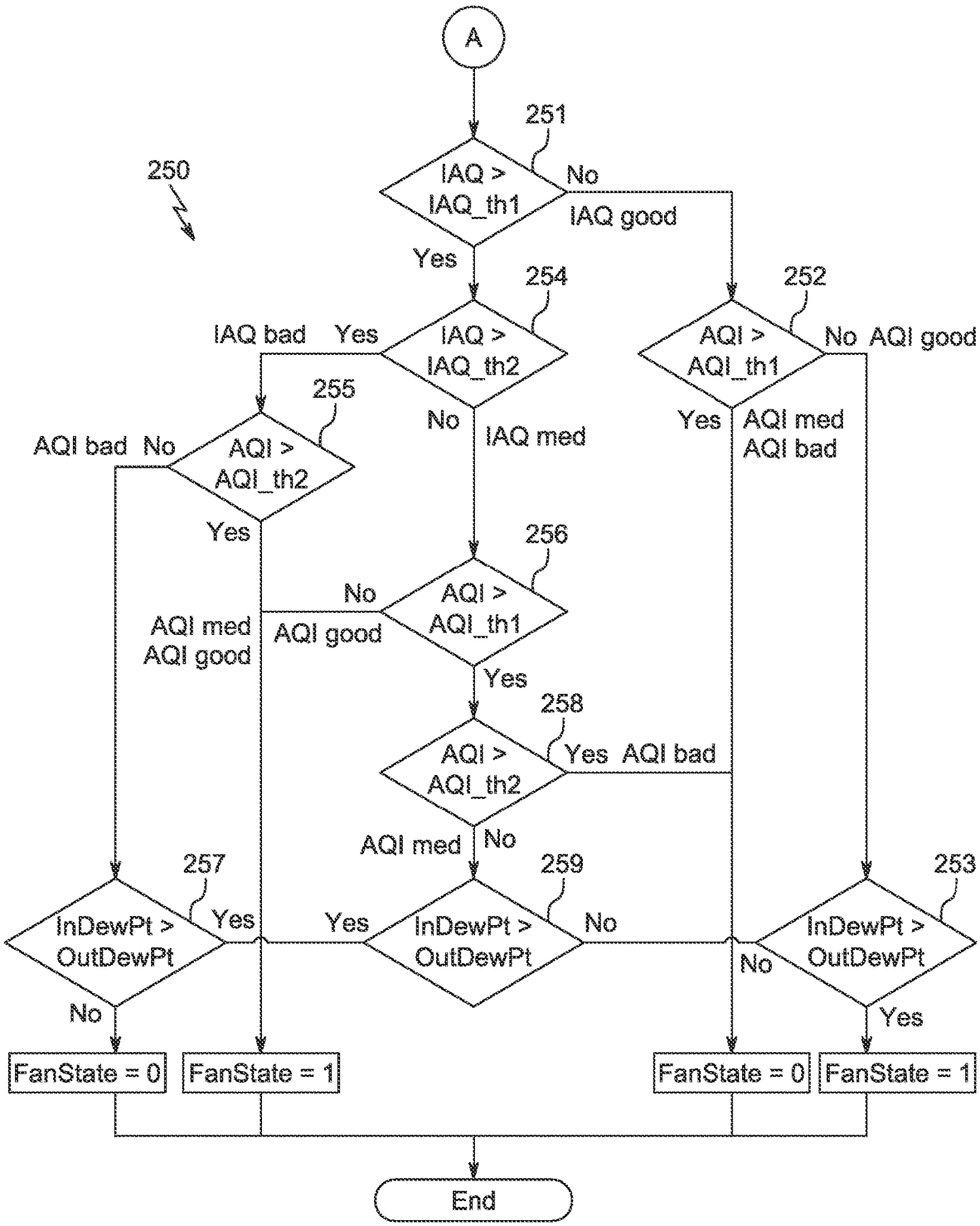

A first schematic flow chart 200 describing the operation of the IAQ system 10 is shown in FIG. 2. In the flow chart of FIG. 2, the IAQ system 10 includes one or more exhaust fans 120/122 and a coupled supply fan 124 with a make-up air damper (MUAD). "Make-up air" is outdoor air brought into the building structure 100 to replace exhausted air and maintain an appropriate air pressure balance between the indoor and outdoor environments. A first step 210 includes determining whether indoor dew point is equal to outdoor dew point levels. This may be assumed or sensed by the monitoring units 102 and by consulting the data source 113 or data provided by one or more appliances 106.

The following ranges of values will be used to indicate good/medium/bad ranges of values and better/worse values as discussed below:

| | Indoor Air Quality Level (IAQ) | Outdoor Air Quality Index (AQI) | Humidity |
|---|---|---|---|
| Good | 0-40 | 0-100 | 40-60% |
| Medium | 41-80 | 101-150 | 10-39% or 61-90% |
| Bad | 81-100 | 151+ | <10% or >90% |

The following ranges will be used to indicate better, worse, and same conditions described below. Better means greater than 10%. Worse means less than 10%. Same means within 10%. In other embodiments, a different range may be used (i.e. 5%, 15%, 20%, etc.). If indoor dew point levels are equal to outdoor dew point levels, the process 200 proceeds to a first ventilation sub-process 220 where only exhaust and supply fans are operated (fan state=1) to vent the local environment 98 depending on air quality levels of both the local environment and the outdoor environment. At a first step 221, the local database/server 110 determines whether the IAQ data from the monitoring devices 102 is greater than a second IAQ threshold (i.e. a bad IAQ). If the IAQ data from the monitoring devices 102 is greater than the second IAQ threshold, the exhaust and supply fans are activated to ventilate the local environment 98. If the IAQ data from the monitoring devices 102 is not greater than the second IAQ threshold, the process 220 proceeds to step 222 where the local database/server 110 determines whether the IAQ data from the monitoring devices 102 is greater than a first IAQ threshold (i.e. a medium IAQ). If the IAQ data from the monitoring devices 102 is not greater than the first IAQ threshold, the exhaust and supply fans are not operated (i.e. fan state=0). If the IAQ data from the monitoring devices 102 is greater than the first IAQ threshold, the process 220 proceeds to a step 223 where the database/server 110 determines whether the outdoor AQI data is greater than a second AQI threshold (i.e. a bad AQI). If the outdoor AQI data is greater than the second AQI threshold, the exhaust and supply fans are not operated. If the outdoor AQI data is not greater than the second AQI threshold, the exhaust and supply fans are operated. The exhaust and supply fans may be modulated depending on if more or less ventilation or other air conditioning action is needed/desired.

Returning to decision step 210, if the indoor dew point is not equal to the outdoor dew point, the process 200 proceeds to a second ventilation sub-process 230 which considers user preference and humidity when determining when to operate the fans and/or other devices. At a first step 231, the user may provide an input into the system 10 to indicate a preference for humidity control (sub-process 240) or IAQ control (sub-process 250).

Sub-process 240 includes a decision step 241 where the database/server 110 determines whether the indoor dew point is greater than the outdoor dew point. If the indoor dew point is greater than the outdoor dew point, the exhaust and supply fans are operated to ventilate the local environment 98 to exchange the less humid outdoor air with the more humid indoor air. The dehumidification device 128 may also be operated to remove moisture from the indoor air. If the indoor dew point is not greater than the outdoor dew point, the exhaust and supply fans are not operated.

Sub-process 250 includes a step 251 where the local database/server 110 determines whether the IAQ data from the monitoring devices 102 is greater than the first IAQ threshold. If the IAQ data from the monitoring devices 102 is not greater than the first IAQ threshold, the sub-process proceeds to a step 252 where the local database/server 110 determines whether the AQI data is greater than a first AQI threshold (i.e. a medium/bad AQI value). If the AQI data is greater than the first AQI threshold, the exhaust and supply fans are not operated. If the AQI data is not greater than the first AQI threshold, the sub-process proceeds to a step 253 where the local database/server determines whether indoor dew point is greater than outdoor dew point. If indoor dew point is greater than outdoor dew point, the exhaust and supply fans are operated. The dehumidification device 128 may also be operated if indoor dew point is greater than outdoor dew point. If indoor dew point is not greater than outdoor dew point, the exhaust and supply fans are not operated.

If the IAQ data from the monitoring devices 102 is greater than the first IAQ threshold, the sub-process proceeds to a step 254 where the local database/server 110 determines whether the IAQ data from the monitoring devices 102 is greater than the second IAQ threshold. If the IAQ data from the monitoring devices 102 is greater than the second IAQ threshold, the sub-process 250 proceeds to step 255 where the local database/server 110 determines whether the AQI data is greater than the second AQI threshold. If the IAQ data from the monitoring devices 102 is not greater than the second IAQ threshold, the sub-process 250 proceeds to step 256 where the local database/server 110 determines whether the AQI data is greater than the first AQI threshold.

From step 255, if the AQI data is greater than the second AQI threshold, the exhaust and supply fans are operated. If the AQI data is not greater than the second AQI threshold, the sub-process 250 proceeds to step 257 where the local database/server 110 determines whether indoor dew point is greater than outdoor dew point. If indoor dew point is greater than outdoor dew point, the exhaust and supply fans are operated. If indoor dew point is not greater than outdoor dew point, the exhaust and supply fans are not operated.

From step 256, if the AQI data is not greater than the first AQI threshold, the exhaust and supply fans are operated. If the AQI data is greater than the first AQI threshold, the sub-process 250 proceeds to a step 258 where the local database/server 110 determines whether the AQI data is greater than the second AQI threshold. If the AQI data is greater than the second AQI threshold, the exhaust and supply fans are not operated. If the AQI data is not greater than the second AQI threshold, the sub-process 250 proceeds to step 259 where the local database/server 110 determines whether indoor dew point is greater than outdoor dew point. If indoor dew point is greater than outdoor dew point, the exhaust and supply fans are operated. If indoor dew point is not greater than outdoor dew point, the exhaust and supply fans are not operated.

Figure 3:
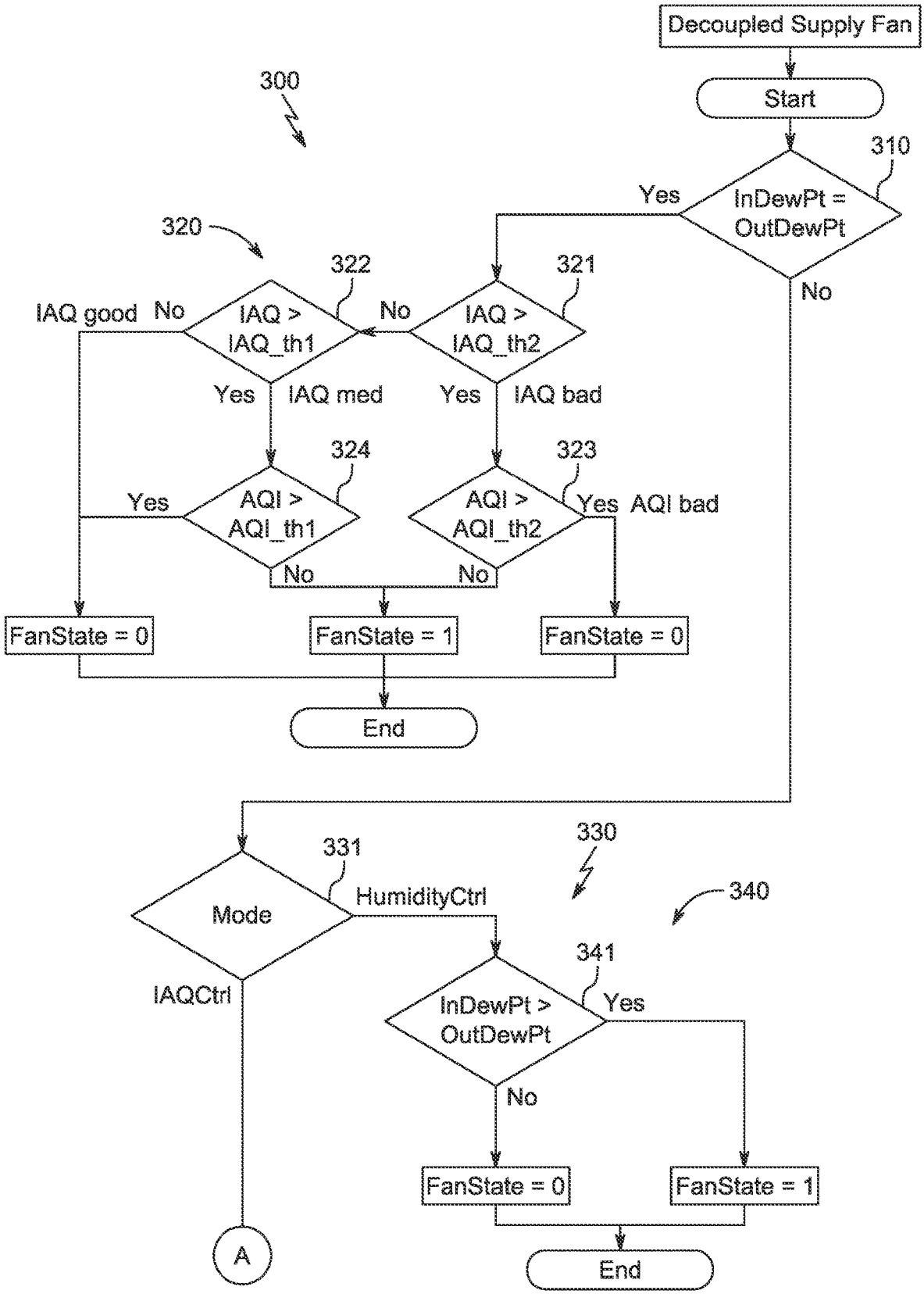
FIG. 3 is a second schematic flow chart describing the operation of the air quality system where the air quality system includes one or more exhaust fans and a de-coupled supply fan.
Figure 3:
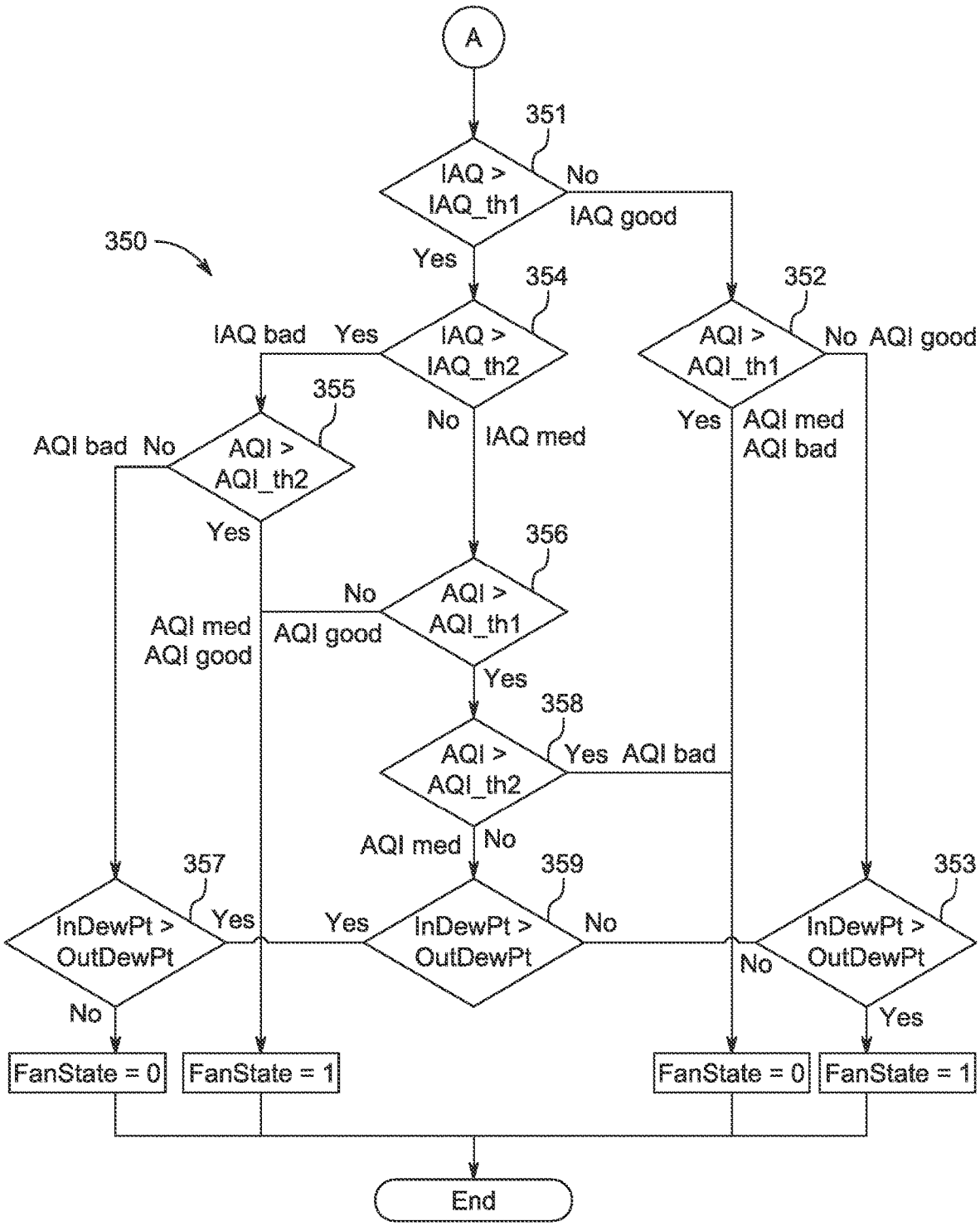

A second schematic flow chart 300 describing the operation of the IAQ system 10 is shown in FIG. 3. In the flow chart of FIG. 3, the IAQ system 10 includes one or more exhaust fans 120/122 and a de-coupled supply fan 124. A first step 310 includes determining whether indoor dew point is equal to outdoor dew point levels. This may be assumed or sensed by the monitoring units 102 and by consulting the data source 113. The same good/medium/bad ranges discussed above apply to process 300. The same ranges for better/worse and same apply to process 300.

If indoor dew point levels are equal to outdoor dew point levels, the process 300 proceeds to a first ventilation sub-process 320 where only exhaust and supply fans are operated (fan state=1) to vent the local environment 98 depending on air quality levels of both the local environment and the outdoor environment. At a first step 321, the local database/server 110 determines whether the IAQ data from the monitoring devices 102 is greater than a second IAQ threshold (i.e. a bad IAQ). If the IAQ data from the monitoring devices 102 is not greater than the second IAQ threshold, the process 320 proceeds to step 322 where the local database/server 110 determines whether the IAQ data from the monitoring devices 102 is greater than a first IAQ threshold (i.e. a medium IAQ). If the IAQ data from the monitoring devices 102 is greater than the second IAQ threshold, the sub-process 320 proceeds to a step 323 where the local database/server 110 determines whether the AQI data is greater than the second AQI threshold.

At step 322, if the IAQ data from the monitoring devices 102 is not greater than the first IAQ threshold, the exhaust and supply fans are not operated (i.e. fan state=0). If the IAQ data from the monitoring devices 102 is greater than the first IAQ threshold, the sub-process 320 proceeds to a step 324 where the local database/server 110 determines if the AQI data is greater than the first AQI threshold. If the AQI data is greater than the first AQI threshold, the exhaust and supply fans are not operated. If the AQI data is not greater than the first AQI threshold, the exhaust and supply fans are operated.

At step 323, if the outdoor AQI data is greater than the second AQI threshold, the exhaust and supply fans are not operated. If the outdoor AQI data is not greater than the second AQI threshold, the exhaust and supply fans are operated.

Returning to decision step 310, if the indoor dew point is not equal to the outdoor dew point, the process 300 proceeds to a second ventilation sub-process 330 which considers user preference and humidity when determining when to operate the fans and/or other devices. At a first step 331, the user may provide an input into the system 10 to indicate a preference for humidity control (sub-process 240) or IAQ control (sub-process 250). Sub-process 340 and sub-process 350 are the same as sub-process 240 and sub-process 250, respectively. Accordingly, the disclosure above is incorporated by reference herein. Similar reference numbers in the 300 series are used to indicate steps common between sub-processes 240, 250 and sub-processes 340, 350.

Figure 4:
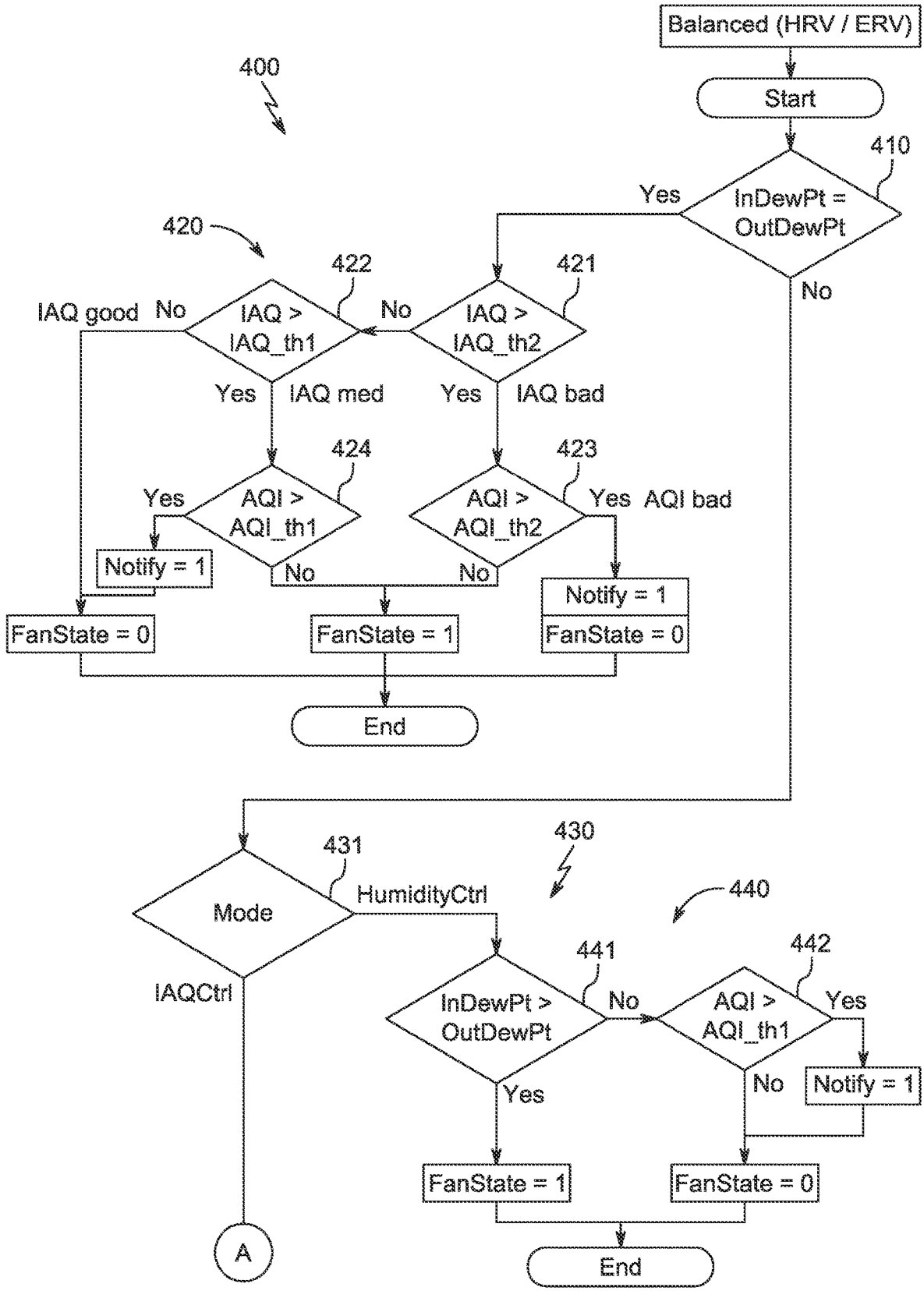
FIG. 4 is a third schematic flow chart describing the operation of the air quality system where the air quality system includes one or more exhaust fans, a coupled or de-coupled supply fan, and the energy/heat recovery device.
Figure 4:
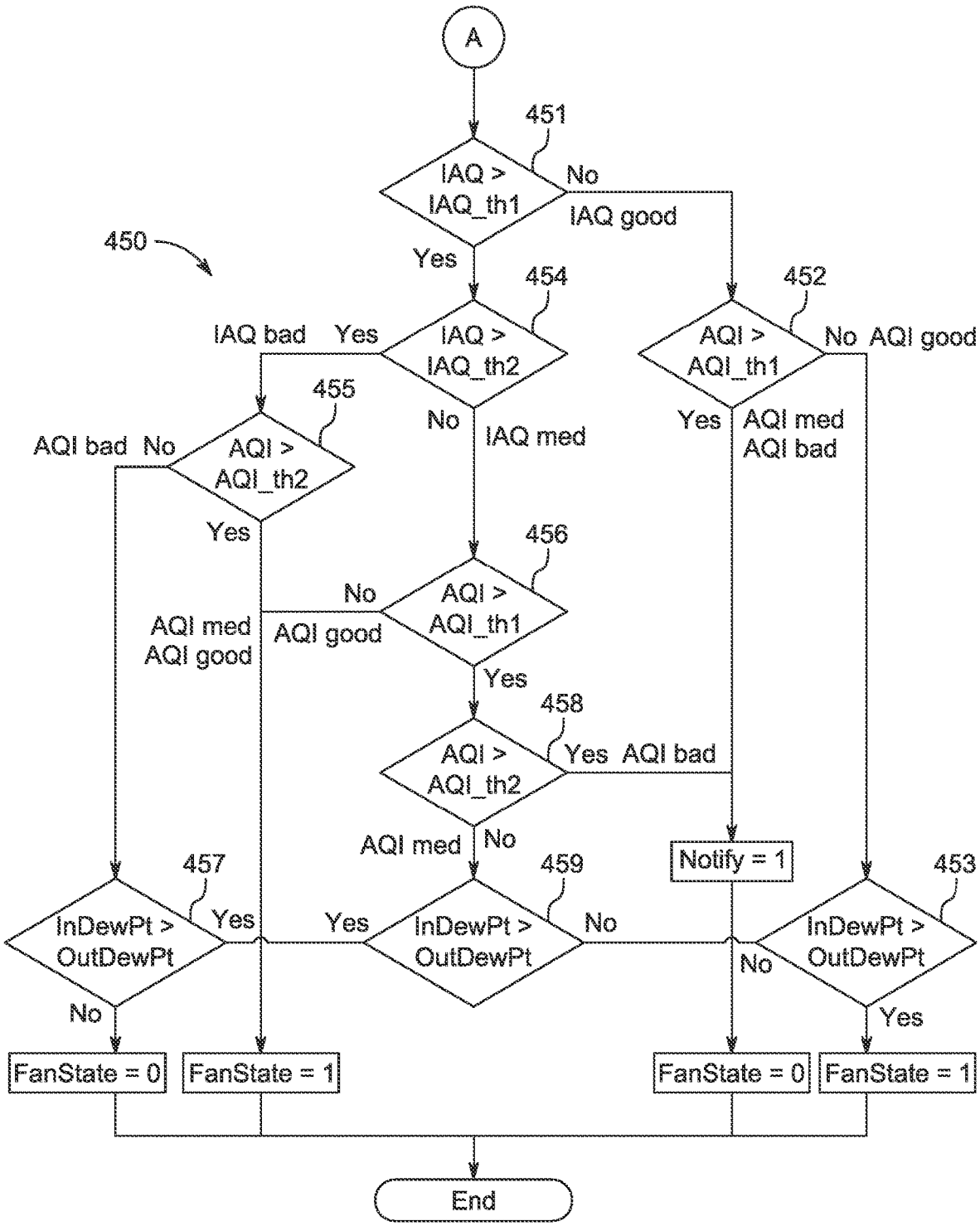

A third schematic flow chart 400 describing the operation of the IAQ system 10 is shown in FIG. 4. In the flow chart of FIG. 4, the IAQ system 10 includes one or more exhaust fans 120/122, a coupled or de-coupled supply fan 124 and the energy/heat recovery device 126. The IAQ system further includes a notification device 114 which may be a fixed panel or user interface in the structure 100 or a mobile device such as s smart-phone, tablet, computer, etc. The notification device 114 is configured to notify a user when certain conditions are present—namely when outdoor AQI data is greater than the first or second AQI data thresholds. This provides the user with a notification that the IAQ system 10 is not operating and a reason for why the IAQ system 10 is not operating. In other embodiments, any alert or message may be output by the IAQ system 10 following an action. For example, the alert may inform the user of a status of the IAQ system 10.

A first step 410 includes determining whether indoor dew point is equal to outdoor dew point levels. This may be assumed or sensed by the monitoring units 102 and by consulting the data source 113. The same good/medium/bad ranges discussed above apply to process 400. The same ranges for better/worse and same apply to process 400.

If indoor dew point levels are equal to outdoor dew point levels, the process 400 proceeds to a first ventilation sub-process 420 where only exhaust and supply fans are operated (fan state=1) to vent the local environment 98 depending on air quality levels of both the local environment and the outdoor environment. If the indoor dew point is not equal to the outdoor dew point, the process 400 proceeds to a second ventilation sub-process 430 which considers user preference and humidity when determining when to operate the fans and/or other devices. At a first step 431, the user may provide an input into the system 10 to indicate a preference for humidity control (sub-process 440) or IAQ control (sub-process 450).

At a first step 421 of sub-process 420, the local database/server 110 determines whether the IAQ data from the monitoring devices 102 is greater than a second IAQ threshold (i.e. a bad IAQ). If the IAQ data from the monitoring devices 102 is not greater than the second IAQ threshold, the process 420 proceeds to step 422 where the local database/server 110 determines whether the IAQ data from the monitoring devices 102 is greater than a first IAQ threshold (i.e. a medium IAQ). If the IAQ data from the monitoring devices 102 is greater than the second IAQ threshold, the sub-process 420 proceeds to a step 423 where the local database/server 110 determines whether the AQI data is greater than the second AQI threshold.

At step 422, if the IAQ data from the monitoring devices 102 is not greater than the first IAQ threshold, the exhaust and supply fans are not operated (i.e. fan state=0). If the IAQ data from the monitoring devices 102 is greater than the first IAQ threshold, the sub-process 420 proceeds to a step 424 where the local database/server 110 determines if the AQI data is greater than the first AQI threshold. If the AQI data is greater than the first AQI threshold, the exhaust and supply fans are not operated and the notification is output by the local database/server 110 and displayed on the notification device 114. If the AQI data is not greater than the first AQI threshold, the exhaust and supply fans are operated.

At step 423, if the outdoor AQI data is greater than the second AQI threshold, the exhaust and supply fans are not operated and the notification is output by the local database/server 110 and displayed on the notification device 114. If the outdoor AQI data is not greater than the second AQI threshold, the exhaust and supply fans are operated.

Sub-process 440 includes a decision step 441 where the database/server 110 determines whether the indoor dew point is greater than the outdoor dew point. If the indoor dew point is greater than the outdoor dew point, the exhaust and supply fans are operated to ventilate the local environment 98 to exchange the less humid outdoor air with the more humid indoor air. The dehumidification device 128 may also be operated to remove moisture from the indoor air. If the indoor dew point is not greater than the outdoor dew point, the sub-process proceeds to a step 442 where the local database/server 110 determines if outdoor AQI data is greater than the first AQI threshold. If the outdoor AQI data is greater than the first AQI threshold the exhaust and supply fans are not operated and the notification is output by the local database/server 110 and displayed on the notification device 114. If the outdoor AQI data is not greater than the first AQI threshold the exhaust and supply fans are not operated and no notification is output by the local database/server 110 or displayed on the notification device 114.

Sub-process 450 includes a step 451 where the local database/server 110 determines whether the IAQ data from the monitoring devices 102 is greater than the first IAQ threshold. If the IAQ data from the monitoring devices 102 is not greater than the first IAQ threshold, the sub-process proceeds to a step 452 where the local database/server 110 determines whether the AQI data is greater than a first AQI threshold (i.e. a medium/bad AQI value). If the AQI data is greater than the first AQI threshold, the exhaust and supply fans are not operated and the notification is output by the local database/server 110 and displayed on the notification device 114. If the AQI data is not greater than the first AQI threshold, the sub-process proceeds to a step 453 where the local database/server determines whether indoor dew point is greater than outdoor dew point. If indoor dew point is greater than outdoor dew point, the exhaust and supply fans are operated. The dehumidification device 128 may also be operated if indoor dew point is greater than outdoor dew point. If indoor dew point is not greater than outdoor dew point, the exhaust and supply fans are not operated.

If the IAQ data from the monitoring devices 102 is greater than the first IAQ threshold, the sub-process proceeds to a step 454 where the local database/server 110 determines whether the IAQ data from the monitoring devices 102 is greater than the second IAQ threshold. If the IAQ data from the monitoring devices 102 is greater than the second IAQ threshold, the sub-process 450 proceeds to step 455 where the local database/server 110 determines whether the AQI data is greater than the second AQI threshold. If the IAQ data from the monitoring devices 102 is not greater than the second IAQ threshold, the sub-process 450 proceeds to step 456 where the local database/server 110 determines whether the AQI data is greater than the first AQI threshold.

From step 455, if the AQI data is greater than the second AQI threshold, the exhaust and supply fans are operated. If the AQI data is not greater than the second AQI threshold, the sub-process 450 proceeds to step 457 where the local database/server 110 determines whether indoor dew point is greater than outdoor dew point. If indoor dew point is greater than outdoor dew point, the exhaust and supply fans are operated. If indoor dew point is not greater than outdoor dew point, the exhaust and supply fans are not operated.

From step 456, if the AQI data is not greater than the first AQI threshold, the exhaust and supply fans are operated. If the AQI data is greater than the first AQI threshold, the sub-process 450 proceeds to a step 458 where the local database/server 110 determines whether the AQI data is greater than the second AQI threshold. If the AQI data is greater than the second AQI threshold, the exhaust and supply fans are not operated and the notification is output by the local database/server 110 and displayed on the notification device 114. If the AQI data is not greater than the second AQI threshold, the sub-process 450 proceeds to step 459 where the local database/server 110 determines whether indoor dew point is greater than outdoor dew point. If indoor dew point is greater than outdoor dew point, the exhaust and supply fans are operated. If indoor dew point is not greater than outdoor dew point, the exhaust and supply fans are not operated.

FIG. 5 shows a schematic flow chart describing an process 500 automatically adjusting threshold values that trigger operation of the appliances 106 of the IAQ system 10. The threshold values are automatically adjusted based on sensed values or conditions from the monitoring devices 102 to block the appliances 106 from unnecessarily and/or continuously running without improving the indoor air quality of the building. The process 500 considers each of the pollutants/effluents described above including TVOC, CO2, PM2.5, etc. In some embodiments, other air quality values may also be considered such as humidity and temperature. Some examples of the threshold values which can be automatically adjusted by the process 500 include all of the thresholds of the IAQ system 10 and the AQI data discussed in processes 200, 300, and 400.

The process 500 begins with a step 502 of determining whether a particular pollutant's average is greater than 90% of a preprogrammed pollutant threshold stored in the IAQ system 10 for that particular pollutant. The pollutant average is calculated by sensed readings of the particular pollutant from one or more monitoring devices 102 located throughout the building over a particular amount of time (i.e. 1 hour, 6 hours, 12 hours, 24 hours, 36 hours, 48 hours, or any other hour value). The pollutant average calculation can be made directly by one or more monitoring devices 102, by the local server 110, or by a separate controller or computer system in communication with or included in the IAQ system 10. Other conditions or parameters may be used to calculate the pollutant average such as AQI data, temperature, humidity, or other pollutant levels, or any other condition which could affect the particular pollutant which threshold is being automatically adjusted. It should be appreciated that while only one pollutant average is discussed above, the IAQ system 10 is capable of independently sensing and automatically adjusting the threshold for multiple pollutant levels at the same time based on pollutant averages of each respective pollutant.

If the pollutant average is greater than 90% of the preprogrammed pollutant threshold, the process 500 proceeds with a step 504 of decreasing a sensitivity value associated with the preprogrammed pollutant threshold. In the illustrative embodiment, the sensitivity value is equal to 0 when the sensitivity value is at the preprogrammed pollutant threshold. The step 504 includes decreasing the sensitivity value by 1 each time the process 500 is iterated through step 504. Each new pollutant sensitivity value calculated by the process 500 (i.e. −1, −2, −3, −4, −5, etc.) is associated with an adjusted pollutant threshold lower than the preprogrammed pollutant threshold. Thus, the IAQ system 10 may operate one or more of the appliances 106 based on the adjusted pollutant threshold set by process 500.

In the illustrative embodiment, the IAQ system 10 is programmed so that the sensitivity value does not exceed a predetermined, lowermost sensitivity value (i.e. −5) during the operation of the process 500. The process 500 proceeds with a step 506 of determining whether the calculated sensitivity value from step 504 is less than or greater than the lowermost sensitivity value. If the calculated sensitivity value is greater than or equal to the lowermost sensitivity value, the IAQ system 10 maintains the adjusted pollutant threshold associated with the lowermost sensitivity value so that the IAQ system 10 does not continue to adjust the pollutant threshold below a lowermost acceptable limit. If the calculated sensitivity value is less than or equal to the lowermost sensitivity value, the IAQ system 10 sets the adjusted pollutant threshold at the value associated the calculated sensitivity value from step 504.

If the pollutant average is less than 90% of the preprogrammed pollutant threshold, the process 500 proceeds with a step 508 of determining whether the pollutant average is less than 85% of a previous pollutant threshold. The previous pollutant threshold may be the preprogrammed pollutant threshold or an adjusted pollutant threshold if the process 500 has already iterated and adjusted the threshold one or more times. If the pollutant average is less than 85% of a previous pollutant threshold, the process 500 proceeds with a step 510 of increasing the sensitivity value that is currently set for that particular pollutant. In the illustrative embodiment, step 510 includes increasing the sensitivity value by 1 each time the process 500 iterates through step 510. If the pollutant average is greater than 85% of a previous pollutant threshold, the process 500 maintains the previous pollutant threshold and ends.

The process 500 proceeds from step 510 with a step 512 of determining whether the adjusted sensitivity value from step 510 is less than 0. If the adjusted sensitivity value from step 510 is less than 0, the system maintains the adjusted sensitivity value. If the adjusted sensitivity value from step 510 is greater than 0, the system sets a sensitivity value of 0. In some embodiments, the system never automatically increases the sensitivity value beyond 0 (i.e. the preprogrammed pollutant threshold).

FIG. 6 is a schematic flow chart describing a process 600 for manually selecting a sensitivity value or level for one or more pollutants and adjusting the preprogrammed threshold for the one or more pollutants. The IAQ system 10 is configured to receive inputs from a user that manually adjusts their sensitivity to a particular pollutant. The IAQ system 10 then automatically adjusts the preprogrammed thresholds for each pollutant that trigger operation of one or more appliances 106 based on the selected sensitivity input by the user.

During process 600, the user inputs a selected sensitivity value or level for one or more pollutants (i.e. TVOC, CO2, PM2.5, etc.) into the IAQ system 10. A lower selected sensitivity value corresponds with a lower threshold that triggers operation of one or more appliances 106 to ventilate the pollutant from the building. A higher selected sensitivity value corresponds with a higher threshold that triggers operation of one or more appliances 106 to ventilate the pollutant from the building. In the illustrative embodiment, the preprogrammed threshold for each pollutant corresponds with a sensitivity value of 0. The user may increase the sensitivity value to 1, 2, 3, 4, 5, etc. to select a higher sensitivity to any particular pollutant. The user may decrease the sensitivity value to −1, −2, −3, −4, −5, etc. to select a lower sensitivity to any particular pollutant.

The process 600 includes a step 602 of determining whether the user's selected sensitivity value is greater than or less than 0. If the user's selected sensitivity value is less than 0, the process 600 proceeds with a step 604 of setting a pollutant threshold based upon a first adjusting function. If the user's selected sensitivity value is greater than 0, the process 600 proceeds with a step 606 of setting a pollutant threshold based upon a second adjusting function. The first adjusting function is calculated based on the users selected sensitivity value less than 0 to provide a highest pollutant threshold for that selected sensitivity value. The second adjusting function is calculated based on the users selected sensitivity value greater than 0 to provide a lowest pollutant threshold for that selected sensitivity value.

In some embodiments, the IAQ system 10 can be controlled by an interface in communication with or included in the IAQ system 10. The interface may be a wall-mounted interface or a mobile device, such as a remote or a handheld computing device (i.e. a smart phone). The interface may include an app in some embodiments. The interface allows a user to select between an auto-adjustment function, as provided by process 500, or a manual-sensitivity selection function, as provided by process 600. Thus, either or both of processes 500 and 600 may include a step of selecting the auto-adjustment function or the manual-sensitivity selection function. The user may individually select which pollutants are controlled by the auto-adjustment function or the manual-sensitivity selection function. Thus, both processes 500, 600 may be executed by the IAQ system 10 at the same time for different pollutants.

According to one aspect of the present disclosure, the disclosed system can be implemented using a computer system in response to a processor executing one or more sequences of one or more instructions contained in memory. Such instructions may be read into memory from another machine-readable medium, such as data storage device. Execution of the sequences of instructions contained in main memory causes the processor to perform the process steps described herein. In alternative implementations, hard-wired circuitry may be used in place of or in combination with software instructions to implement various implementations of the present disclosure. Thus, implementations of the present disclosure are not limited to any specific combination of hardware circuitry and software.

Issues related to indoor air quality may be exasperated by outdoor air quality. Forest fires, smog, pollen and other external factors can all affect outdoor air quality. The IAQ system includes a database of ongoing outdoor air quality data including but not limited to weather, particulates, outdoor temperature, and outdoor humidity. The present disclosure integrates an outdoor weather API so that the system can make better ventilation decisions based upon both indoor as well as outdoor conditions in combination. Outdoor Air Quality Index (AQI) information may be displayed in on a user interface. References to outdoor AQI health issues including but not limited to irritated eyes, coughing, as well as risks to health may also be displayed on the user interface.

A user of the IAQ system may input their home zip code during initial setting up of the IAQ. This input may be used when accessing the weather API to define the nearest weather station and associated AQI data. The user may also have the option of selecting an alternate available weather station from the API within their zip code. The IAQ system may have a default selection for humidity or outdoor AQI based upon zip code/climate zone.

The AQI or elements thereof could be used to forecast/predict future events and used in the system algorithm. For example, if high PM2.5 is forecasted for the upcoming day from the weather API, the system algorithm may call for a longer ventilation period ahead of the predicted problematic forecast. The overall AQI score (numeric value of several constituents (CO, NO2, O3, PM2.5, PM10, NO2, SO2) and outdoor humidity/temperature may be used to simplify the algorithm. In other embodiments, one or more individual outdoor AQI constituents may be utilized independently instead of the overall AQI score to further improve the precision of the system algorithm. Operation of the IAQ system 10 may consider energy costs, in some embodiments.

In some embodiments, the present disclosure provides an automatic, dynamically adjusting indoor air quality threshold for ventilation activation that acclimates to the use environment over time. This may allow the IAQ system 10 to work favorably in a wider variety of climate regions and environmental conditions, while still providing inhabitants of the building with improved indoor air quality. This automatic adjustment methodology may also allow for seasonal changes to be accounted for throughout the year.

The present disclosure may allow the IAQ system 10 to accommodate environmental changes without forcing the ventilation equipment 106 to operate continuously. Hysteresis is built into/programmed into the system 10 to allow the thresholds to change, but not cycle back and forth between two different states.

In some embodiments, the moving average/smoothing function is an exponential average and monitors humidity, CO2, PM2.5, and TVOC in combination or individually. Each pollutant may be monitored and adjusted individually for optimal performance and improved indoor air quality.

In some embodiments, the auto sensitivity settings for each pollutant are selected/set in a mobile app. The auto sensitivity can be selected for an individual or multiple pollutant as determined/desired by the installer/end user. Indicators on the mobile app show the current dynamic setting of the auto sensitivity feature with respect to static pollutant thresholds preprogrammed into the IAQ system 10.

In one example, humidity may be a major concern in the southern part of the United States, and customers in those regions may have issues with conventional humidity control devices operating without the IAQ system 10. The auto adjustment function of the IAQ system 10 may allow system to work better in these climates. In some situations, newly constructed homes may have higher TVOC levels for prolonged periods of time following construction. In these cases, the auto sensitivity setting may ensure that the ventilation devices are not running unnecessarily/continuously when a long-term running average of an air pollutant is determined/calculated.

In some embodiments, performing threshold adjustments automatically takes the manual adjustment need away from users, who may not know how to or that they can/should make these adjustments to their system to optimize indoor air quality. Manual adjustment of the indoor air quality thresholds may be provided where more control over their indoor air quality is desired or where set thresholds that are lower than the preprogrammed standards are desired.

The following numbered clauses include embodiments that are contemplated and non-limiting:

Clause 1. A method of controlling ventilation of air within a local environment of a structure.

Clause 2. The method of clause 1, any other suitable clause, or any combination of suitable clauses, including determining an indoor air quality level based on signals from one or more monitoring devices located in the local environment.

Clause 3. The method of clause 2, any other suitable clause, or any combination of suitable clauses, including obtaining an outdoor air quality index value from an external data source.

Clause 4. The method of clause 3, any other suitable clause, or any combination of suitable clauses, including comparing the indoor air quality level to the outdoor air quality index value.

Clause 5. The method of clause 4, any other suitable clause, or any combination of suitable clauses, including activating one or more appliances to ventilate the local environment of the structure when one or both of the indoor air quality level and the outdoor air quality index value are outside of a predetermined threshold.

Clause 6. The method of clause 5, any other suitable clause, or any combination of suitable clauses, wherein the method is performed by an indoor air quality system including at least one monitoring device, at least one appliance and a local database/server coupled to the monitoring device, the appliance, and the data source.

Clause 7. The method of clause 6, any other suitable clause, or any combination of suitable clauses, wherein the indoor air quality system includes a plurality of monitoring devices with at least one of the monitoring devices being located in a room of the structure, and wherein the method further includes obtaining air quality levels from each room in which a monitoring device is located and averaging the air quality levels to determine an overall indoor air quality level of the local environment.

Clause 8. The method of clause 6, any other suitable clause, or any combination of suitable clauses, wherein the at least one appliance includes an exhaust fan, a supply fan, and/or a make-up air damper.

Clause 9. The method of clause 8, any other suitable clause, or any combination of suitable clauses, wherein the exhaust fan and the supply fan are activated in response to the local database/server determining that: (i) the indoor air quality level is less than a first IAQ threshold, (ii) the outdoor air quality index value is less than a first AQI threshold, and (iii) an indoor dew point of the local environment is greater than an outdoor dew point outside of the structure.

Clause 10. The method of clause 9, any other suitable clause, or any combination of suitable clauses, wherein the exhaust fan and the supply fan do not activate when: (i) the indoor air quality level is less than the first IAQ threshold and (ii) the outdoor air quality index value is greater than the first AQI threshold.

Clause 11. The method of clause 9, any other suitable clause, or any combination of suitable clauses, wherein the exhaust fan and the supply fan are also activated in response to the local database/server determining that: (i) the indoor air quality level is greater than the first IAQ threshold, (ii) the indoor air quality level is greater than a second IAQ threshold, and (iii) the outdoor air quality index value is greater than a second AQI threshold.

Clause 12. The method of clause 9, any other suitable clause, or any combination of suitable clauses, wherein the exhaust fan and the supply fan are activated in response to the local database/server determining that: (i) the indoor air quality level is greater than the first IAQ threshold, (ii) the indoor air quality level is less than a second IAQ threshold, and (iii) an indoor dew point of the local environment is greater than an outdoor dew point outside of the structure.

Clause 13. The method of clause 8, any other suitable clause, or any combination of suitable clauses, wherein the exhaust fan and the supply fan are activated in response to the local database/server determining that (i) the indoor air quality level is greater than a first IAQ threshold, (ii) the indoor air quality level is less than a second IAQ threshold, (iii) the outdoor air quality index value is greater than a first AQI threshold, (iv) the outdoor air quality index value is less than a second AQI threshold, and (v) an indoor dew point of the local environment is greater than an outdoor dew point outside of the structure.

Clause 14. The method of clause 5, any other suitable clause, or any combination of suitable clauses, further comprising a step of selecting preference for air quality control, humidity control, or time-varying rates for electricity.

Clause 15. The method of clause 5, any other suitable clause, or any combination of suitable clauses, further comprising a step of calculating a pollutant average of one or more pollutants in the local environment and adjusting the predetermined threshold based on the pollutant average.

Clause 16. The method of clause 15, any other suitable clause, or any combination of suitable clauses, wherein the pollutant average is determined based on readings from the one or more monitoring devices over a predetermined amount of time.

Clause 17. The method of clause 15, any other suitable clause, or any combination of suitable clauses, wherein the step of activating one or more appliances includes activating at least one of an exhaust fan and a supply fan when the predetermined threshold is reached and the step of automatically adjusting the predetermined threshold occurs based on a determination that at least one of the exhaust fan and the supply fan have been operating for a predetermined period of time and a determination that one or more pollutant levels have not reached a predetermined, acceptable level within the predetermined period of time.

Clause 18. The method of clause 15, any other suitable clause, or any combination of suitable clauses, wherein the method further includes calculating a sensitivity value based on the pollutant average and, when the pollutant average is greater than 90% of a preprogrammed pollutant threshold, the sensitivity value is lowered, and when the pollutant average is less than 90% of the preprogrammed pollutant threshold, the sensitivity value is raised.

Clause 19. The method of clause 15, any other suitable clause, or any combination of suitable clauses, further comprising a step of manually selecting a sensitivity level for at least one pollutant and predetermined threshold for the at least one pollutant is changed based on the sensitivity level.

Clause 20. A method of controlling ventilation of air within a local environment of a structure, the method comprising determining an indoor air quality level based on signals from one or more monitoring devices located in the local environment indicative of a pollutant level within the local environment.

Clause 21. The method of clause 20, any other suitable clause, or any combination of suitable clauses, including activating one or more appliances to ventilate the local environment of the structure when the pollutant level is outside of a predetermined threshold, Clause 22. The method of clause 21, any other suitable clause, or any combination of suitable clauses, including calculating a pollutant average of the pollutant level in the local environment.

Clause 23. The method of clause 22, any other suitable clause, or any combination of suitable clauses, including automatically adjusting the predetermined threshold based on the pollutant average.

Clause 24. The method of clause 23, any other suitable clause, or any combination of suitable clauses, wherein the pollutant average is determined based on readings from the one or more monitoring devices over a predetermined amount of time.

Clause 25. The method of clause 23, any other suitable clause, or any combination of suitable clauses, wherein the step of activating one or more appliances includes activating at least one of an exhaust fan and a supply fan when the predetermined threshold is reached and the step of adjusting the predetermined threshold occurs based on a determination that at least one of the exhaust fan and the supply fan have been operating for a predetermined period of time and a determination that one or more pollutant levels have not reached a predetermined, acceptable level within the predetermined period of time.

Clause 26. The method of clause 23, any other suitable clause, or any combination of suitable clauses, the method further includes calculating a sensitivity value based on the pollutant average and, when the pollutant average is greater than 90% of a preprogrammed pollutant threshold, the sensitivity value is lowered, and when the pollutant average is less than 90% of the preprogrammed pollutant threshold, the sensitivity value is raised.

Clause 27. The method of clause 23, any other suitable clause, or any combination of suitable clauses, further comprising a step of manually selecting a sensitivity level for at least one pollutant and predetermined threshold for the at least one pollutant is changed based on the sensitivity level.

Clause 28. The method of clause 23, any other suitable clause, or any combination of suitable clauses, wherein the pollutant level is a humidity level.

Clause 29. A system for controlling ventilation of air within a local environment of a structure.

Clause 30. The system of clause 29, any other suitable clause, or any combination of suitable clauses, including at least one monitoring device located in the local environment and configured to identify a pollutant level within the local environment.

Clause 31. The system of clause 30, any other suitable clause, or any combination of suitable clauses, including a processor.

Clause 32. The system of clause 30, any other suitable clause, or any combination of suitable clauses, including a processor configured to determine an indoor air quality level based on the pollutant level identified by the at least one monitoring device.

Clause 33. The system of clause 32, any other suitable clause, or any combination of suitable clauses, wherein the processor is configured to determine a pollutant average of the pollutant level in the local environment based on the pollutant levels identified by the at least one monitoring device.

Clause 34. The system of clause 33, any other suitable clause, or any combination of suitable clauses, wherein the processor is configured to adjust a predetermined threshold based on the pollutant average.

Clause 35. The system of clause 34, any other suitable clause, or any combination of suitable clauses, including at least one appliance configured to ventilate the local environment of the structure when the pollutant level is outside of the predetermined threshold.

Clause 36. The system of clause 35, any other suitable clause, or any combination of suitable clauses, wherein the system is provided with a default predetermined threshold and the processor is configured to adjust the default predetermined threshold based on the pollutant average.

Clause 37. The system of clause 35, any other suitable clause, or any combination of suitable clauses, wherein the processor is configured to determine the pollutant average based on readings from the one or more monitoring devices over a predetermined amount of time.

Clause 38. The system of clause 33, any other suitable clause, or any combination of suitable clauses, wherein the at least one appliance comprises an exhaust fan and a supply fan.

Clause 39. The system of clause 35, any other suitable clause, or any combination of suitable clauses, the processor is configured to adjust the predetermined threshold based on a determination that both (a) at least one of the at least one appliances has operated for a predetermined period of time and (b) that one or more pollutant levels have been reduced to a predetermined, acceptable level within the predetermined period of time.

Clause 40. The system of clause 35, any other suitable clause, or any combination of suitable clauses, the processor is preprogrammed with a sensitivity value and is configured to calculate a new sensitivity value based on the pollutant average, wherein the sensitivity value is lowered when the pollutant average is greater than 90% of a preprogrammed pollutant threshold and the sensitivity value is raised when the pollutant average is less than 90% of the preprogrammed pollutant threshold.

Clause 41. The system of clause 35, any other suitable clause, or any combination of suitable clauses, wherein the pollutant level is a humidity level.

While the present disclosure describes various exemplary embodiments, the disclosure is not so limited. To the contrary, the disclosure is intended to cover various modifications, uses, adaptations, and equivalent arrangements based on the principles disclosed. Further, this disclosure is intended to cover such departures from the present disclosure as come within at least the known or customary practice within the art to which it pertains. It is envisioned that those skilled in the art may devise various modifications and equivalent structures and functions without departing from the spirit and scope of the disclosure as recited in the following claims.

The invention claimed is:

1. A method of controlling ventilation of air within a local environment of a structure, the method comprising determining an indoor air quality level based on signals from one or more monitoring devices located in the local environment, obtaining an outdoor air quality index value from an external data source, comparing the indoor air quality level to the outdoor air quality index value, activating one or more appliances to ventilate the local environment of the structure when one or both of the indoor air quality level and the outdoor air quality index value are outside of a predetermined threshold, and calculating a pollutant average of one or more pollutants in the local environment and adjusting the predetermined threshold based on the pollutant average, wherein the step of activating one or more appliances includes activating at least one of an exhaust fan, a supply fan, or a make-up air damper when the predetermined threshold is reached and the step of adjusting the predetermined threshold occurs based on a determination that the at least one of the exhaust fan, the supply fan, or the make-up air damper have been operating for a predetermined period of time and a determination that one or more pollutant levels have not reached a predetermined, acceptable level within the predetermined period of time.

2. The method of claim 1, wherein the method is performed by an indoor air quality system including at least one monitoring device, at least one appliance and a local database/server coupled to the at least one monitoring device, the appliance, and the data source.

3. The method of claim 2, wherein the at least one monitoring device comprises a plurality of monitoring devices, at least one of the monitoring devices is located in a room of the structure, and the method further includes obtaining air quality levels from each room in which one or more of the plurality of monitoring devices is located and averaging the air quality levels to determine an overall indoor air quality level of the local environment.

4. The method of claim 1, wherein the at least one of the exhaust fan, the supply fan, or the make-up air damper is activated in response to a local database/server determining that: (i) the indoor air quality level is less than a first IAQ threshold, (ii) the outdoor air quality index value is less than a first AQI threshold, and (iii) an indoor dew point of the local environment is greater than an outdoor dew point outside of the structure.

5. The method of claim 4, wherein the at least one of the exhaust fan, the supply fan, or the make-up air damper does not activate when: (i) the indoor air quality level is less than the first IAQ threshold and (ii) the outdoor air quality index value is greater than the first AQI threshold.

6. The method of claim 4, wherein the at least one of the exhaust fan, the supply fan, or the make-up air damper is activated in response to the local database/server determining that: (i) the indoor air quality level is greater than the first IAQ threshold, (ii) the indoor air quality level is greater than a second IAQ threshold, and (iii) the outdoor air quality index value is greater than a second AQI threshold.

7. The method of claim 4, wherein the at least one of the exhaust fan, the supply fan, or the make-up air damper is activated in response to the local database/server determining that: (i) the indoor air quality level is greater than the first IAQ threshold, (ii) the indoor air quality level is less than a second IAQ threshold, and an indoor dew point of the local environment is greater than an outdoor dew point outside of the structure.

8. The method of claim 1, wherein the at least one of the exhaust fan, the supply fan, or the make-up air damper is activated in response to a local database/server determining that (i) the indoor air quality level is greater than a first IAQ threshold, (ii) the indoor air quality level is less than a second IAQ threshold, (iii) the outdoor air quality index value is greater than a first AQI threshold, (iv) the outdoor air quality index value is less than a second AQI threshold, and (v) an indoor dew point of the local environment is greater than an outdoor dew point outside of the structure.

9. The method of claim 1, further comprising a step of selecting a preference for air quality control, humidity control, or time-varying rates for electricity.

10. The method of claim 1, further comprising a step of manually selecting a sensitivity level for at least one pollutant, wherein a predetermined threshold for the at least one pollutant is changed based on the sensitivity level.

11. A method of controlling ventilation of air within a local environment of a structure, the method comprising determining an indoor air quality level based on signals from one or more monitoring devices located in the local environment, obtaining an outdoor air quality index value from an external data source, comparing the indoor air quality level to the outdoor air quality index value, activating one or more appliances to ventilate the local environment of the structure when one or both of the indoor air quality level and the outdoor air quality index value are outside of a predetermined threshold, calculating a pollutant average of one or more pollutants in the local environment and adjusting the predetermined threshold based on the pollutant average, and calculating a sensitivity value based on the pollutant average and, when the pollutant average is greater than 90% of a preprogrammed pollutant threshold, the sensitivity value is lowered, and when the pollutant average is less than 90% of the preprogrammed pollutant threshold, the sensitivity value is raised.

12. A method of controlling ventilation of air within a local environment of a structure, the method comprising determining an indoor air quality level based on signals from one or more monitoring devices located in the local environment indicative of a pollutant level within the local environment, activating one or more appliances to ventilate the local environment of the structure when the pollutant level is outside of a predetermined threshold, wherein the step of activating one or more appliances includes activating at least one of an exhaust fan and a supply fan when the predetermined threshold is reached, calculating a pollutant average of the pollutant level in the local environment, and automatically adjusting the predetermined threshold based on (i) the pollutant average, (ii) a determination that at least one of the exhaust fan and the supply fan have been operating for a predetermined period of time, and (iii) a determination that one or more pollutant levels have not reached a predetermined, acceptable level within the predetermined period of time.

13. The method of claim 12, wherein the pollutant average is determined based on readings from the one or more monitoring devices over a predetermined amount of time.

14. The method of claim 12, further comprising a step of manually selecting a sensitivity level for at least one pollutant, wherein a predetermined threshold for the at least one pollutant is changed based on the sensitivity level.

15. The method of claim 12, wherein the pollutant level is a humidity level.

16. A method of controlling ventilation of air within a local environment of a structure, the method comprising determining an indoor air quality level based on signals from one or more monitoring devices located in the local environment indicative of a pollutant level within the local environment, activating one or more appliances to ventilate the local environment of the structure when the pollutant level is outside of a predetermined threshold, calculating a pollutant average of the pollutant level in the local environment, automatically adjusting the predetermined threshold based on the pollutant average, and calculating a sensitivity value based on the pollutant average and, when the pollutant average is greater than 90% of a preprogrammed pollutant threshold, the sensitivity value is lowered, and when the pollutant average is less than 90% of the preprogrammed pollutant threshold, the sensitivity value is raised.

17. A system for controlling ventilation of air within a local environment of a structure, the system comprising at least one monitoring device located in the local environment and configured to identify a pollutant level within the local environment;

a processor configured to determine an indoor air quality level based on the pollutant level identified by the at least one monitoring device, determine a pollutant average in the local environment based on multiple pollutant levels identified by the at least one monitoring device; and adjust a predetermined threshold based on the pollutant average;

at least one appliance configured to ventilate the local environment of the structure when the pollutant level is outside of the predetermined threshold, wherein the processor is configured to adjust the predetermined threshold based on a determination that both (a) at least one of the at least one appliance has operated for a predetermined period of time and (b) that one or more pollutant levels have been reduced to a predetermined, acceptable level within the predetermined period of time.

18. The system of claim 17, wherein the system is provided with a default predetermined threshold and the processor is configured to adjust the default predetermined threshold based on the pollutant average.

19. The system of claim 17, wherein the processor is configured to determine the pollutant average based on readings from the at least one monitoring device over a predetermined amount of time.

20. The system of claim 17, wherein the at least one appliance comprises an exhaust fan and a supply fan.

21. The system of claim 17, wherein the pollutant level is a humidity level.

22. A system for controlling ventilation of air within a local environment of a structure, the system comprising at least one monitoring device located in the local environment and configured to identify a pollutant level within the local environment;

a processor configured to determine an indoor air quality level based on the pollutant level identified by the at least one monitoring device, determine a pollutant average in the local environment based on multiple pollutant levels identified by the at least one monitoring device; and adjust a predetermined threshold based on the pollutant average;

at least one appliance configured to ventilate the local environment of the structure when the pollutant level is outside of the predetermined threshold, wherein the processor is preprogrammed with a sensitivity value and is configured to calculate a new sensitivity value based on the pollutant average, wherein the sensitivity value is lowered when the pollutant average is greater than 90% of a preprogrammed pollutant threshold and the sensitivity value is raised when the pollutant average is less than 90% of the preprogrammed pollutant threshold.

* * * * *